US006964303B2

(12) United States Patent
Mazorow et al.

(10) Patent No.: US 6,964,303 B2
(45) Date of Patent: Nov. 15, 2005

(54) HORIZONTAL DIRECTIONAL DRILLING IN WELLS

(75) Inventors: Henry B. Mazorow, Lorain, OH (US); Paris E. Blair, Casper, WY (US); Chris Sanfelice, Kearns, UT (US)

(73) Assignee: Performance Research & Drilling, LLC, Lorain, OH (US)

( * ) Notice: Subject to any disclaimer, the term of this patent is extended or adjusted under 35 U.S.C. 154(b) by 49 days.

(21) Appl. No.: 10/189,637

(22) Filed: Jul. 3, 2002

(65) Prior Publication Data

US 2002/0162689 A1 Nov. 7, 2002

(Under 37 CFR 1.47)

Related U.S. Application Data

(63) Continuation of application No. 09/788,210, filed on Feb. 16, 2001, now Pat. No. 6,578,636.

(60) Provisional application No. 60/182,932, filed on Feb. 16, 2000, and provisional application No. 60/199,212, filed on Apr. 24, 2000.

(51) Int. Cl.[7] ..... E21B 29/06

(52) U.S. Cl. ..... 166/298; 166/55; 166/55.7; 175/80

(58) Field of Search ..... 175/77, 78, 79–82, 175/62, 61; 166/298, 55, 55.1, 55.6, 55.7

(56) References Cited

U.S. PATENT DOCUMENTS

| | | | |
|---|---|---|---|
| 1,367,042 A | 2/1921 | Ganville | |
| 1,485,615 A | 3/1924 | Jones | |
| 1,733,311 A | 10/1929 | McNeill | |
| 1,804,819 A | 5/1931 | Spencer, Jr. et al. | |
| 1,904,819 A | 3/1933 | Blodgett | |

(Continued)

FOREIGN PATENT DOCUMENTS

| | | | |
|---|---|---|---|
| JP | 1134037 | 5/1989 | |
| JP | 5331903 | 12/1993 | |
| SU | 1208197 | * 1/1986 | ..... 166/55.8 |

OTHER PUBLICATIONS

Bozidar Omrcen et al., "Application and Results of Petro Jet® Multilateral Drilling in Croatin", PJMLS: Oct. 2001, Int'l Conf., pp. 1–22.

*Findings of Fact and Conclusion of Law, Carl Landers et al.* v. *Sideways, LLC*, U.S. District Court, Western District of Kentucky, Civil Action No. 4:00CV–35–M, Judge Joseph H. McKinley, Jr., Mar. 11, 2004, pp. 1–51, including pp. 10–20.

"Hole Saw Kits & Accessories", including products from The L.S. Starrett Company, product catalog, p. 24, dated before Feb. 28, 2000.

The L.S. Starrett Company, "Saw Blades", Starrett webpage (2 pages) for Catalog No. KV1090 for "Automotive Hole Saw Kit", 2001.

*Primary Examiner*—Hoang Dang
(74) *Attorney, Agent, or Firm*—Pearne & Gordon LLP

(57) ABSTRACT

A method and apparatus for horizontally drilling in wells utilizing a shoe assembly at the down hole end of upset tubing. The shoe assembly includes a fixed section and a rotatable section suspended below the fixed section. An electric motor and associated batteries and a gyroscope carried on the rotatable section enable an operator on the surface to selectively rotate and position the rotatable section to any desired angular location for drilling a hole in the well casing. After one or more holes have been cut in the casing, a drill assembly can be removed from the upset tubing and be replaced by a high pressure blaster nozzle to bore into the formation zones. The gyroscope enables the operator to accurately position the rotatable section to the same locations at which the holes have been cut. The drill assembly includes an electric motor with an associated battery, flexible drive shaft, and a hole saw.

33 Claims, 6 Drawing Sheets

U.S. PATENT DOCUMENTS 2,065,436 A 12/1936 Ervin
2,117,277 A * 5/1938 Dyer ..... 166/298
2,181,512 A * 11/1939 Kirby ..... 175/51
2,181,980 A * 12/1939 Seale ..... 175/78
2,213,498 A * 9/1940 Kinzbach ..... 166/55.3
2,251,916 A 8/1941 Cross
2,271,005 A 1/1942 Grebe
2,360,425 A * 10/1944 Kinzbach ..... 166/55.3
2,500,785 A 3/1950 Arutunoff
2,516,421 A * 7/1950 Robertson ..... 175/78
2,521,976 A 9/1950 Hays
2,539,047 A * 1/1951 Arutunoff ..... 175/40
2,633,682 A * 4/1953 Jackson ..... 451/541
3,191,697 A * 6/1965 Haines ..... 175/81
3,224,506 A 12/1965 Huitt et al.
3,262,508 A 7/1966 Price
3,670,831 A 6/1972 Winter, Jr. et al.
3,797,576 A 3/1974 Azalbert et al.
3,838,736 A 10/1974 Driver
3,840,079 A 10/1974 Williamson
3,853,185 A 12/1974 Dahl et al.
3,873,156 A 3/1975 Jacoby
3,958,649 A 5/1976 Bull et al.
4,007,797 A 2/1977 Jeter
4,160,616 A 7/1979 Winblad
4,168,752 A 9/1979 Sabol
4,185,705 A 1/1980 Bullard
4,251,172 A 2/1981 Durand
4,354,558 A 10/1982 Jageler et al.
4,365,676 A 12/1982 Boyadjieff et al.
4,368,786 A 1/1983 Cousins
4,431,069 A 2/1984 Dickinson, III et al.
4,445,574 A 5/1984 Vann
4,474,252 A 10/1984 Thompson
4,526,242 A 7/1985 Mathieii et al.
4,533,182 A 8/1985 Richards
4,589,499 A 5/1986 Behrens
4,601,353 A 7/1986 Schuh et al.
4,640,353 A 2/1987 Schuh
4,640,362 A 2/1987 Schellstede
4,646,831 A 3/1987 Marsh et al.
4,658,916 A 4/1987 Bond
4,763,734 A 8/1988 Dickinson et al.
4,786,874 A 11/1988 Grosso et al.
4,790,384 A 12/1988 Schellstede et al.
4,832,143 A 5/1989 Kaalstad et al.
4,832,552 A 5/1989 Skelly
4,836,611 A 6/1989 El-Saie
4,842,487 A 6/1989 Buckman et al.
4,848,486 A 7/1989 Bodine
4,854,400 A 8/1989 Simpson
4,890,681 A 1/1990 Skelly
4,947,944 A 8/1990 Coltman et al.
5,006,046 A 4/1991 Buckman et al.
5,012,877 A * 5/1991 Winters et al. ..... 175/80
RE33,660 E 8/1991 Jelsma
5,090,496 A 2/1992 Walker
5,113,953 A 5/1992 Noble
5,148,877 A 9/1992 MacGregor
5,148,880 A 9/1992 Lee et al.
5,161,617 A * 11/1992 Marschke ..... 166/298
5,165,491 A 11/1992 Wilson
5,183,111 A 2/1993 Schellstede
5,194,859 A 3/1993 Warren
5,210,533 A 5/1993 Summers et al.
5,259,466 A 11/1993 Venditto et al.
5,318,121 A 6/1994 Brockman et al.
5,327,970 A 7/1994 McQueen et al.
5,330,016 A 7/1994 Paske et al.
5,392,856 A 2/1995 Broussard, Jr. et al.
5,394,951 A 3/1995 Pringle et al.
5,396,966 A 3/1995 Roos, Jr. et al.
5,410,303 A 4/1995 Comeau et al.
5,413,184 A 5/1995 Landers
5,439,066 A 8/1995 Gipson
5,458,209 A 10/1995 Hayes et al.
5,528,566 A 6/1996 McGee et al.
5,553,680 A 9/1996 Hathaway
RE35,386 E 12/1996 Wu et al.
5,687,806 A 11/1997 Sallwasser et al.
5,699,866 A * 12/1997 Cousins et al. ..... 175/78
5,853,056 A 12/1998 Landers
5,892,460 A 4/1999 Jerabek et al.
5,899,958 A 5/1999 Dowell et al.
5,934,390 A 8/1999 Uthe
5,944,123 A 8/1999 Johnson
5,987,385 A 11/1999 Varsamis et al.
6,003,599 A 12/1999 Heber et al.
6,012,526 A 1/2000 Jennings et al.
6,076,602 A * 6/2000 Gano et al. ..... 166/298
6,125,949 A 10/2000 Landers
6,155,343 A 12/2000 Nazzal et al.
6,173,773 B1 1/2001 Almaguer et al.
6,189,629 B1 * 2/2001 McLeod et al. ..... 175/67
6,260,623 B1 7/2001 Schick
6,263,984 B1 7/2001 Buckman, Sr.
6,283,230 B1 9/2001 Peters
6,352,109 B1 3/2002 Buckman, Sr.
6,378,629 B1 4/2002 Baird
6,412,578 B1 7/2002 Baird
6,550,553 B2 4/2003 Baird
6,588,517 B2 7/2003 Baird
6,668,948 B2 12/2003 Buckman, Sr. et al.
2002/0070013 A1 6/2002 Bond

* cited by examiner

HORIZONTAL DIRECTIONAL DRILLING IN WELLS

This application is a continuation of U.S. patent application Ser. No. 09/788,210 filed Feb. 16, 2001, now U.S. Pat. No. 6,578,636, which claims the priority of U.S. Provisional Patent Application No. 60/182,932 filed Feb. 16, 2000, and U.S. Provisional Patent Application No. 60/199,212 filed Apr. 24, 2000.

BACKGROUND OF INVENTION

The invention relates to not only new wells, but also to revitalizing preexisting vertical and horizontal oil and gas vertical wells that have been depleted or are no longer profitable, by improving the porosities of the wells' payzone formations. This is accomplished by providing a micro channel through the already existing casing, and out into the formation.

PRIOR ART

After a well has been drilled, completed, and brought on-line for production, it may produce oil and gas for an unknown period of time. It will continue to produce hydrocarbons, until the production drops below a limit that proves to be no longer profitable to continue producing, or it may stop producing altogether. When this happens, the well is either abandoned or stimulated in a proven and acceptable process. Two of these processes are called Acidizing and Fracturizing. Acidizing uses an acid to eat away a channel in the formation thus allowing the hydrocarbons an easier access back to the well bore. Fracturizing uses hydraulic pressure to actually crack and split the formation along preexisting cracks in the formation. Both of these methods increase the formation's porosity by producing channels into the formation allowing the hydrocarbons to flow easier towards the annulus of the well which increases the production of the well along with it's value. However, the success of these operations is highly speculative. In some wells, it may increase the production rate of a well many times over that of it's previous record, but in others, they may kill the well forever. In the latter case the well must be plugged and abandoned. Both Acidizing and Fracturizing are very expensive. Both require dedicated heavy mobile equipment, such as pump trucks, water trucks, holding tanks, cranes along with a large crew of specialized personnel to operate the equipment.

A more efficient method of stimulating a vertical well is to drill a hole in the well casing, and then bore a micro-horizontal channel into the payzone using a high pressure water jet to produce a channel for the hydrocarbons to follow back to the well bore's annulus. Once an initial lateral hole through the already existing casing, has been produced. The micro drill must be brought back to the surface. Then a high pressure water jet nozzle is lowered into the well and through the above-mentioned hole in the casing and out into the payzone. It then produces a finite lengthened channel out radially away from the well bore into the payzone. Once this is completed, it to must be brought back to the surface.

Because of the limitations of the present technology, the entire drill string is then manually rotated from the surface to blindly rotate the drill shoe (located at the bottom of the drill string) for the next drilling and boring operation. The process is repeated until the desired number of holes/bores has been reached.

It is very difficult and imperfect to rotate an entire drill string, so that the exit hole of the shoe, which is located at the bottom of the drill string, is pointing exactly in the desired direction. For example, if the well casing is tilted or off-line, the drill string may bind so that the top portion rotates while the bottom portion (including the shoe) may not actually move or move less than the rotation at the surface. This is due to the fact that all of the applied torque does not reach completely to the bottom of the drill string due to friction encountered up hole from the shoe.

SUMMARY OF THE INVENTION

The invention provides a method and apparatus that allows the for the drilling and completion of a plurality of lateral holes in the well casing in one step, removal of the drill, then lowering of the blasting nozzle and re-entering each of the holes in succession to horizontally bore into the formation without interruptions or without having to turn the entire drill string at the surface to realign with each hole.

In accordance with the invention, the shoe assembly consists of a fixed section and a rotating working section. The fixed section is threaded into the down hole end of upset tubing, such as straight tubing or coiled tubing or any other method known in the art, to lower the entire shoe assembly to a desired depth. The fixed section provides a central channel or passage to allow a drill apparatus (with a flexible drill shaft and a special cutting tool) to be inserted into the assembly.

The rotatable working section is attached to the fixed section by a specially designed guide housing and ring gear that facilitates the turning of the turns the rotating section within the well casing. The ring gear converts the rotation of a motor driven transfer bar or drive shaft, turned by a self contained bi-directional variable speed DC motor, into rotation of this section. The DC motor is controlled by an operator at the surface and is powered by a self-contained lithium battery. The rotating section has a rotating vertical bore that passes through the center of the ring gear and into an elbow-shaped channel that changes the direction of the of the flexible shaft and cutter from a vertical entry into a horizontal exit to allow the drilling of holes in the well casing.

A gyroscope in the rotatable section communicates the precise angular position of the rotatable section to the operator on the surface via a multiconductor cable or by wireless transmission to allow the operator to align the rotating section to the desired position to cut the hole. The operator can then reorient the rotatable section of the shoe assembly for sequential drilling operations, if desired. When the drill is retracted and the water jet nozzle is then lowered back through the shoe, the operator again reorients the shoe assembly.

The drill apparatus, comprised of a housing, a shaft and a bit, may be of any type desired that will fit inside the upset tubing and through the shoe. The bit preferably is a hole cutter comprised of a hollow cylindrical body with a solid base at one end and a series of cutters or teeth at the other end. The terminal end of the body is serrated or otherwise provided with a cutting edge or edges. As the serrated edge of the cutter contacts the inside of the well casing, it begins to form a circular groove into the casing. As pressure is applied, the groove deepens until a disc (coupon) is cut out of the casing.

Sensors can be installed in the shoe assembly so that lights or alarming devices, on the operator's console located at the surface can indicate a variety of information:

a. The drill has entered the shoe and is seated correctly.

b. The bit has cut through the casing and the hole is completed.

A core can be substituted for the hole cutter that would allow for the side of the casing and part of the formation to be cored. The cores could be brought to the surface to show the condition of the casing and the thickness of the cement. A mill can be substituted for the cutter to allow the casing to be cut in two if the casing was damaged. The use of a cutter and motor can be replaced with a series or battery of small shaped charges to produce the holes in the side of the casing. If the well bore is filled with liquid, the shoe can be modified to accept a commercial sonar device. This creates a system that can be rotated a full 360 degrees to reflect interior defects or imperfections. If the well bore is devoid of liquids, the shoe can be modified to accept a sealed video camera. This creates a system to provide a 360 degree view of all interior defects and imperfections.

DESCRIPTION OF PREFERRED EMBODIMENT

Figure 1:
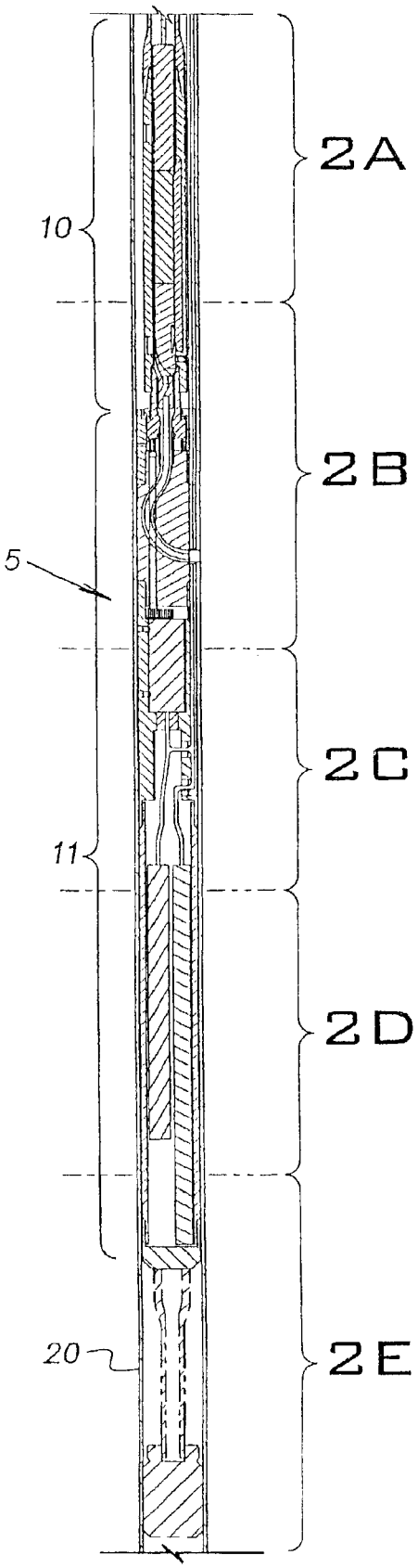
FIG. 1 is a vertical cross-sectional view of apparatus constructed in accordance with the invention and positioned in a deep well casing.
Figure 2A:
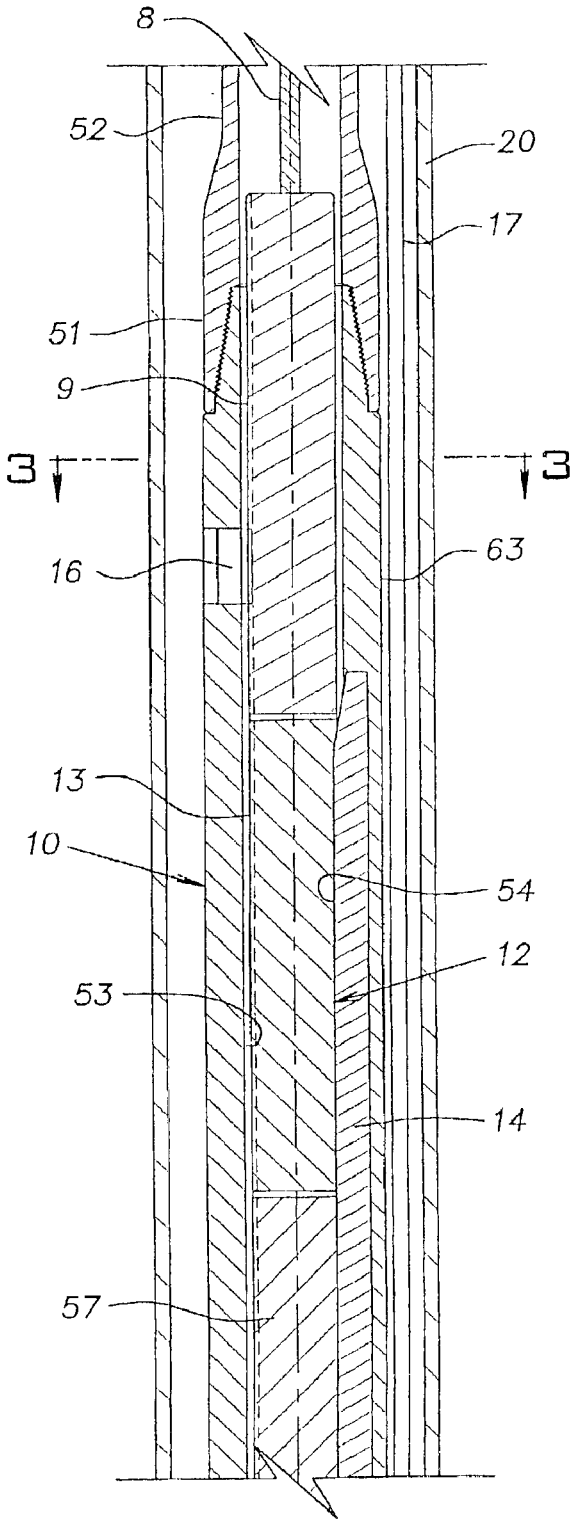
FIGS. 2A through 2E are cross-sectional views of the apparatus on a somewhat enlarged scale corresponding to the bracketed areas shown in FIG. 1.
Figure 2B:
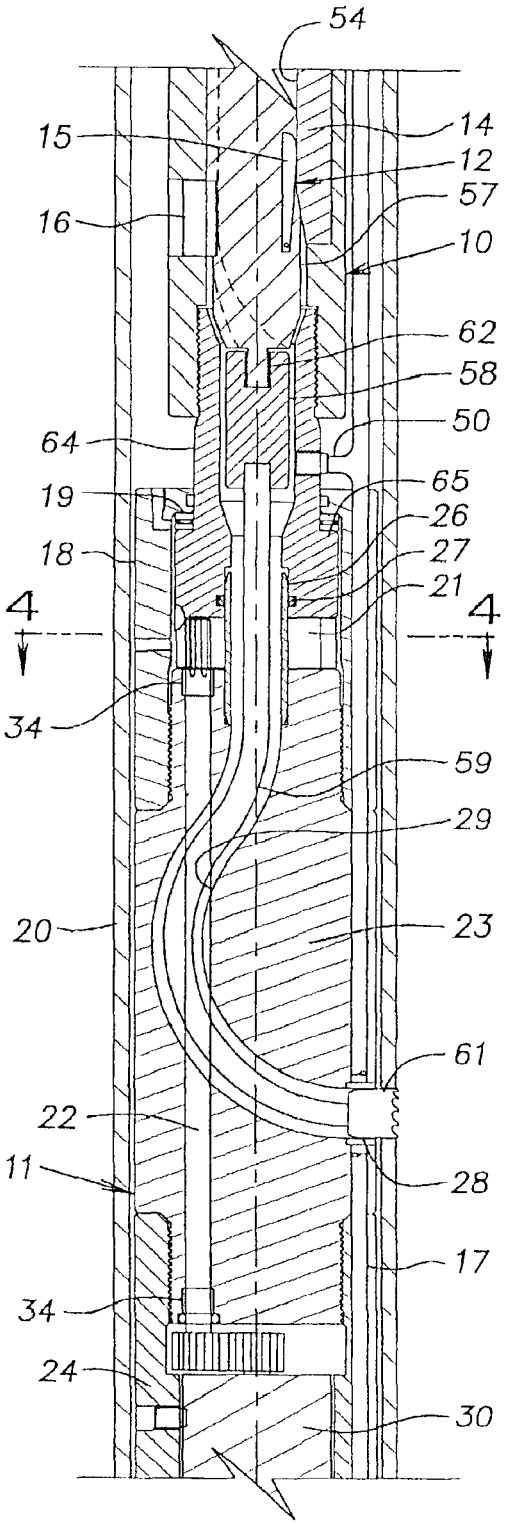
Figure 2C:
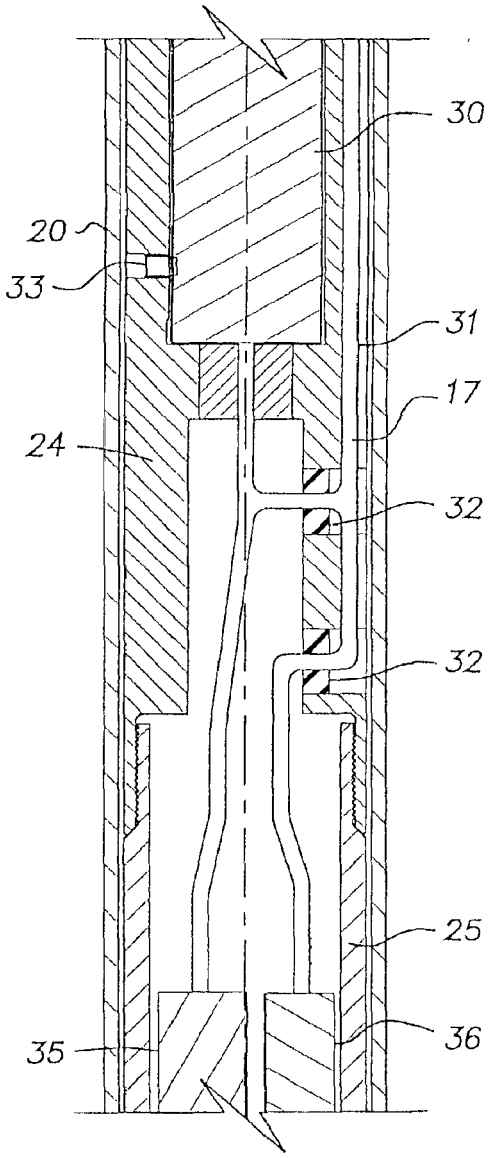
Figure 2D:
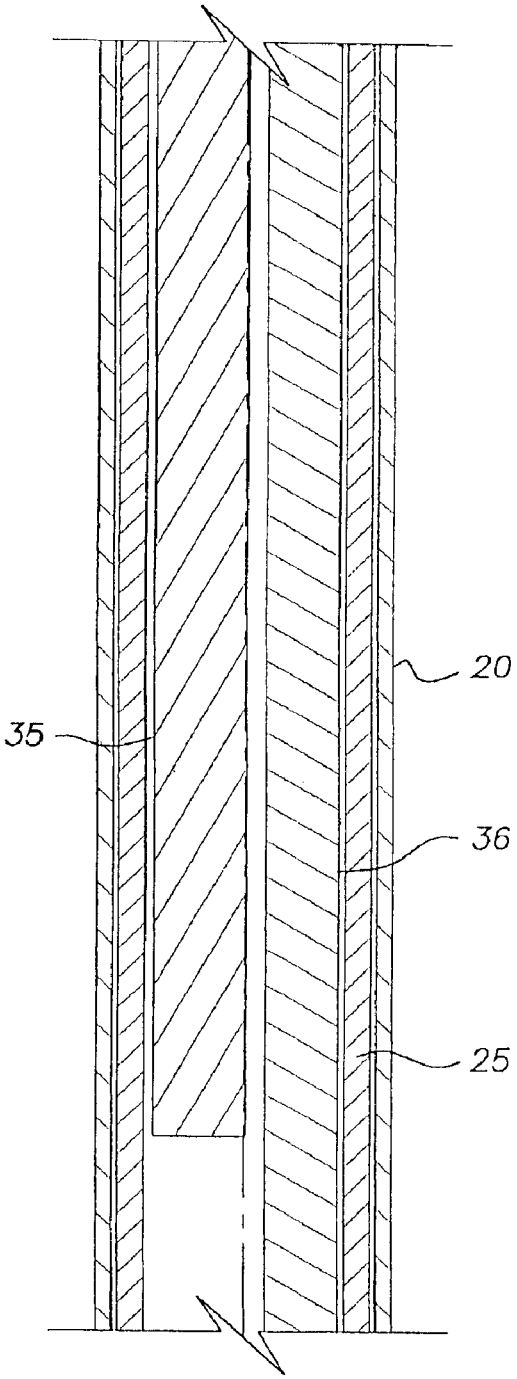
Figure 2E:
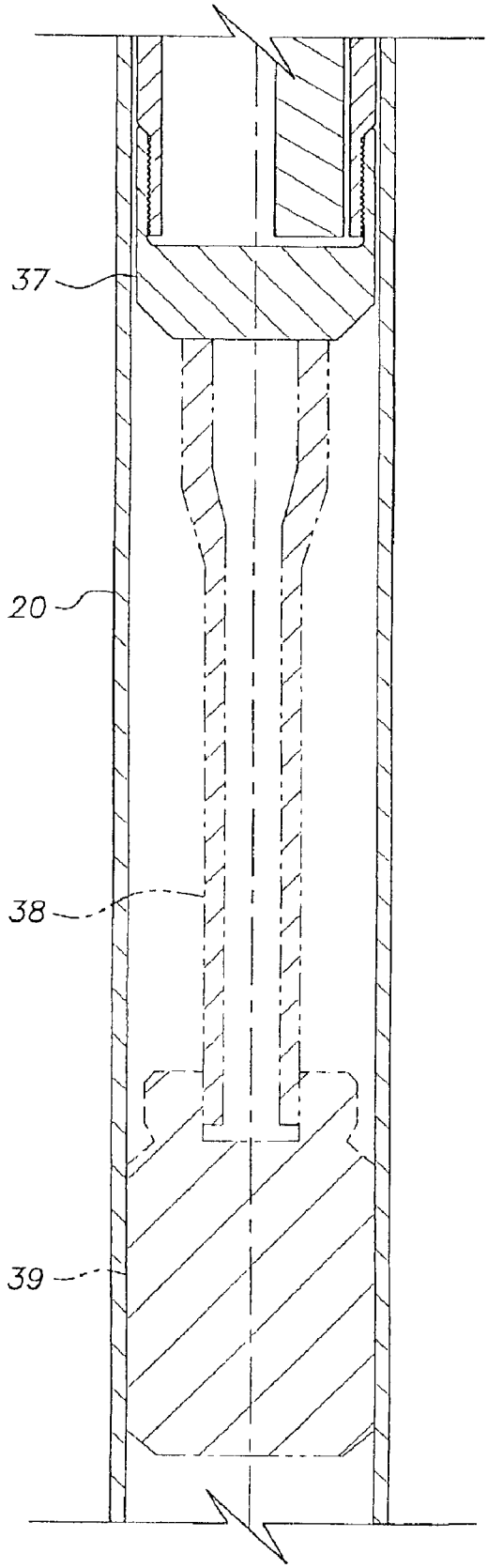

The entire contents of U.S. Provisional Patent Application No. 60/182,932, filed Feb. 16, 2000 and U.S. Provisional Patent Application No. 60/199,212, filed Apr. 24, 2000 are incorporated herein by reference.

FIG. 1 and FIGS. 2A through 2E schematically illustrate components of a cylindrical shoe assembly 5 capable of horizontally drilling into vertical well casings 20 and boring into hydrocarbon payzones in oil and gas wells. It will be understood that the invention has other applications from the following description, such as employing a coring bit that would core into the side of the well casing 20 and part of the surrounding formation to determine the casing condition and the composition of the surrounding formation, using a milling tool to cut the well casing 20 in two, employing a series or battery of small, shaped charges to produce holes in the side of the casing 20 or to use a video camera or sonar device to locate and determine interior defects and imperfections in the well casing 20.

The cylindrical shoe assembly 5 is composed of a fixed section 10, below which a rotatable working section 11 is attached.

Figure 3:
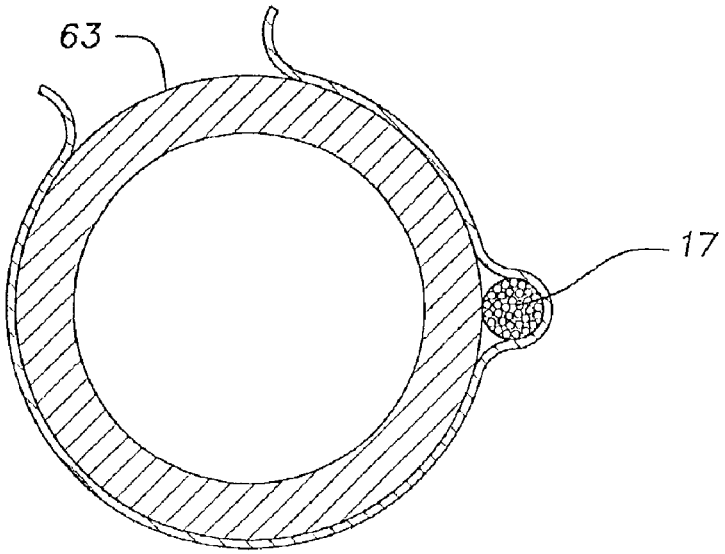
FIG. 3 is a transverse cross-sectional view of the apparatus taken in the plane 3—3 indicated in FIG. 2A.
Figure 6:
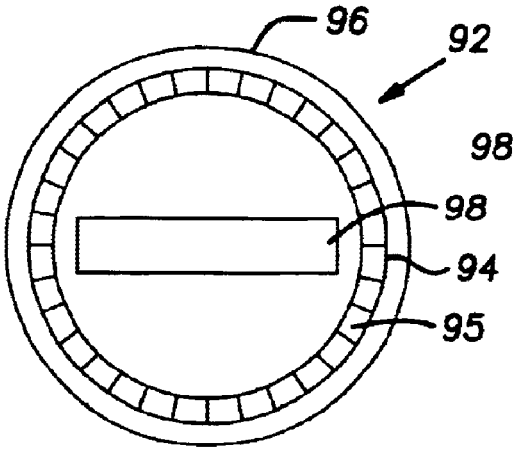
FIG. 6 is a top view (shown looking toward the serrated edge) of a preferred hole cutter according to the invention.
Figure 7:
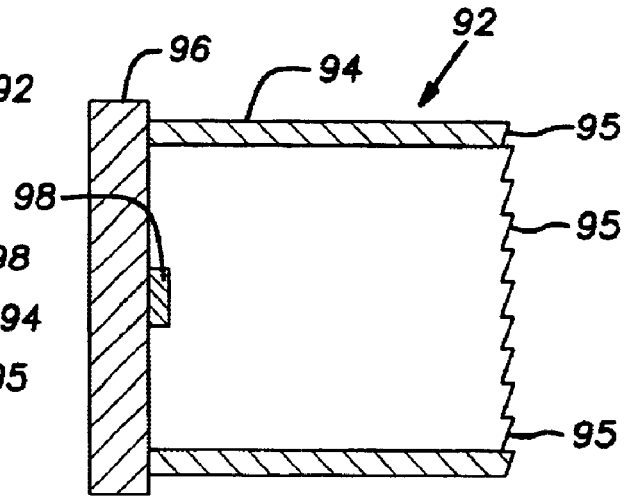
FIG. 7 is a side view, in cross-section, of the hole cutter in FIG. 6.

The fixed section 10 is threaded into the down hole end 51 of upset tubing 52, or straight tubing or coiled tubing. The upset tubing 52 enables the shoe assembly 5 to be lowered to a desired depth within the well casing 20. The fixed section 10 has a central channel or passage 53 to allow for the insertion and retraction of a drill apparatus 12 that is comprised of sinker bars 9 of a selected total weight to insure sufficient pressure for cutting, a battery 13, a drill motor 57, chuck 58, a flexible drill shaft 59, and a cutter 61. (The cutter is preferably a hole cutter 61 as shown in FIGS. 6–7 and described in detail below). The sinker bars 9, battery 13 and drill motor 57 are threaded into each other and the total apparatus 12 is vertically supported from the surface for raising and lowering by a high strength stranded wire cable 8 as known in the art. The down hole housing of the drill motor has a self aligning surface, such as used on a universal down hole orientation sub known in the art, to self align the drill apparatus 12 with anti spin lugs 16 fixed into the inner wall of the channel 53 to prevent the apparatus 12 from rotating. The chuck 58 is threaded onto a shaft 62 of the drill motor 57. The flexible drill shaft 59 is silver soldered or otherwise fixed to the base of the chuck 58. A ramp 14 with a cam surface 54 is welded into a slot in the channel 53 of the fixed section wall on which a mechanical switch 15 rides to turn the drill motor 57 on. A proximity sensor 50 in an inner guide housing 64 senses the presence of the chuck 58; a signal from the sensor is transmitted in a multi-conductor cable. The multi-conductor cable 17 conducts signals for controlling the rotation of the working section 11 and indicating its angular position to the operator on the surface via gyro 36. This cable is banded to the exterior of the wall 52 of the drill string from the shoe to the surface. This is to keep it from snagging on the inside of the well casing 20 and becoming damaged while tripping in or out of the hole, as shown in FIG. 3.

A hole cutter 61 as described in the preceding paragraph can be constructed by modifying commercially available hole saws, such as hole saws sold by the L.S. Starrett Company of Athol, Massachusetts as part of the "Automotive Kit" which is Starrett's Catalog No. K1090 and EDP No. 63818. Other hole saws known in the art can also be used for this purpose. In use, the serrated edge of the hole cutter 61 is contacted with the inside of a well casing. The hole cutter is rotated and begins to form an annulus in the casing. As more pressure is applied to the hole cutter 61, the annulus deepens until a disc is cut out of the casing. This is described in more detail below.

The fixed inner guide housing 64 threaded into the down hole end of the fixed section 10 provides a shoulder 65 onto which a cylindrical end cap 18, into which the rotating section 11 is threaded, sits supported by oil filled thrust bearings 19 that allow the rotating section 11 to turn within the well casing 20.

Figure 4:
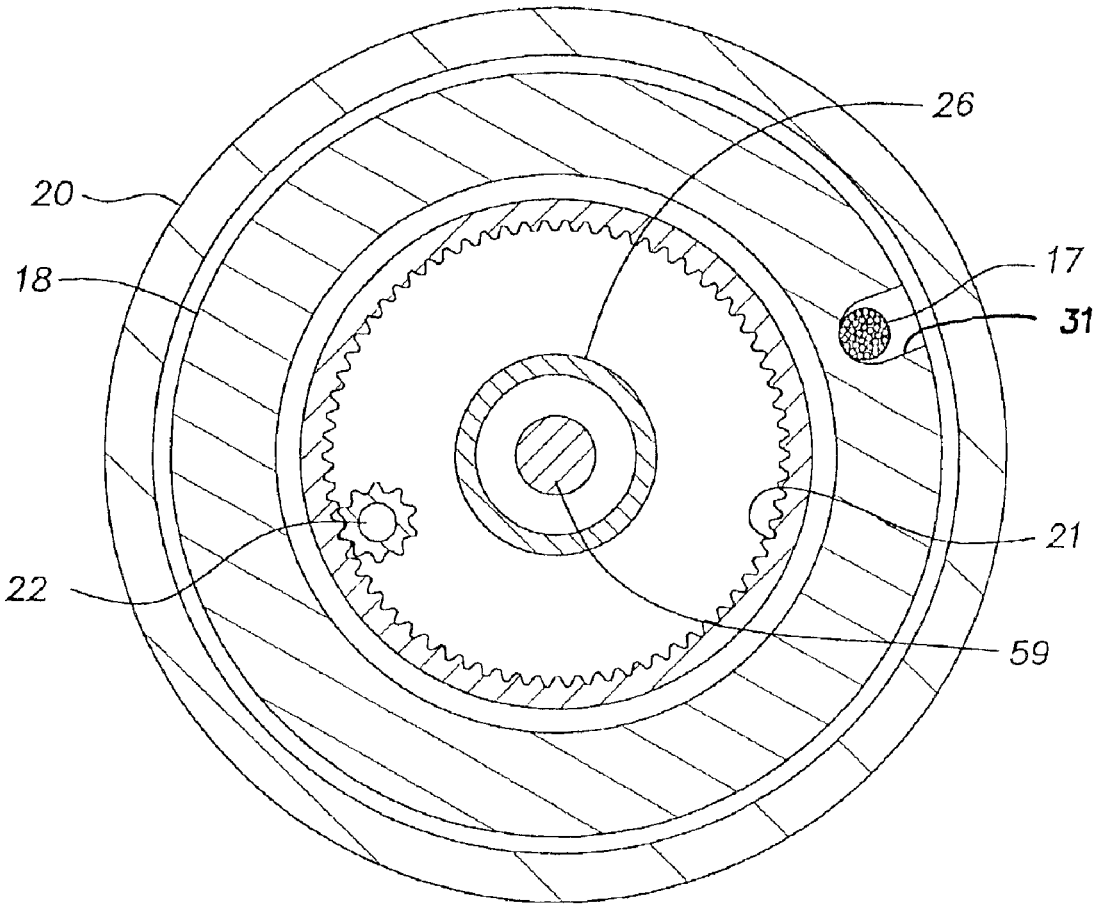
FIG. 4 is a transverse cross-sectional view of the apparatus taken in the plane 4—4 indicated in FIG. 2B.

The rotating section 11 comprises a cylindrical cutter support body 23, a cylindrical motor housing 24, a cylindrical battery/gyroscope housing 25, and a metal shoe guide 37. A ring gear 21, detailed in FIG. 4, is welded to or otherwise fixed to the base of the inner guide housing 64 to convert the turning of a transfer bar or drive shaft 22 into rotation of this section 11 in respect to the upper fixed section 10. The inner guide housing 64 also provides an annular clearance to allow free rotation of the flexible drill shaft chuck 58 that is threaded onto the drill motor shaft 62.

A rotating vertical sleeve 26 sealed by an o-ring 27 is recessed in a counter bore in the inner guide housing 64. The sleeve 26 passes through the center of the ring gear 21 and is pressed or otherwise fixed into the cylindrical cutter support body 23. The body 23 is threaded into or otherwise fixed to the cylindrical end cap 18. At it's lower end, the body 23 is threaded into the cylindrical motor housing 24. The rotating sleeve 26 guides the hole cutter 61 and the flexible drill shaft 59 into an elbow-shaped channel 29, of circular cross-section, formed in the cylindrical cutter support body 23, that changes the direction from a vertical entry into a horizontal exit. A hardened bushing 28, in the cutter support body 23 works as a bearing to support the hole cutter 61 for rotation and guides the hole cutter 61 in a radial direction.

Figure 5:
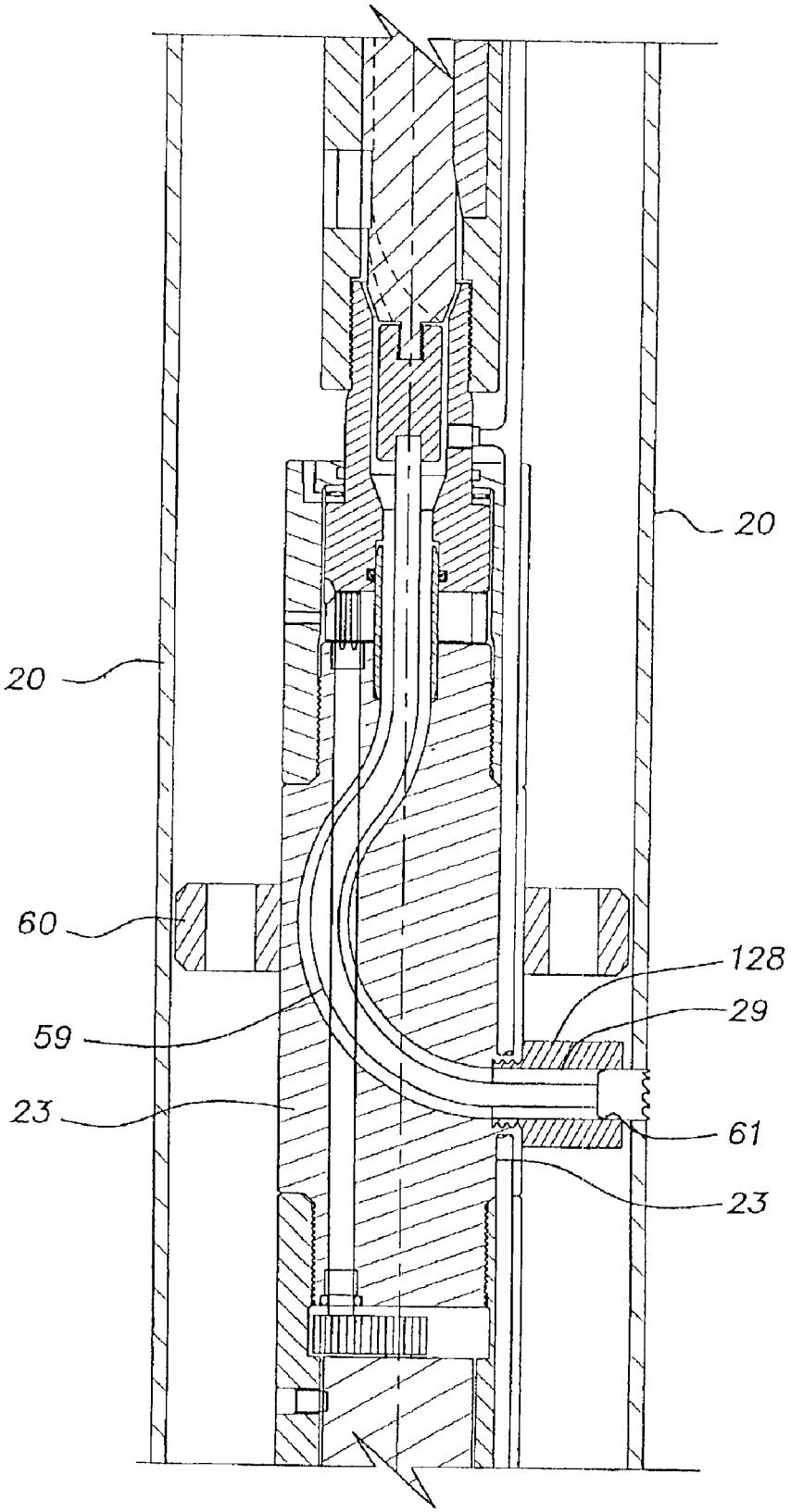
FIG. 5 is a vertical cross-sectional view of a modified form of certain parts of the apparatus.

Various sized centralizing rings 60 and modified bushings 128, shown in FIG. 5, may be used so that the same shoe assembly 5 can be used in casings of different inside diameters. These centralizing rings 60 are screwed, welded, bolted or otherwise fixed at selected locations on the outside of the shoe assembly 5. The centralizing ring 60 should be notched, channeled or shaped like a star so only a few points touch the casing, to allow for the free flow of fluid, gas and fines past the shoe and up and down the inside of the well casing. This design also aids in the insertion and withdrawal of the shoe from the casing acting as a centralizing guide within the casing walls 20. Alternatively, the bushing 128 can be integral with a centralizing ring.

While the preferred hole cutter 61 is a hole saw, other cutters such as a milling cutter or other cutters known in the art may be used. Referring to FIGS. 6–7, the preferred cutter 61 comprises a hollow cylindrical body 94 with a solid base 96 at its proximal end and cutting teeth 95 or abrading elements known in the art, at the terminal or serrated end. Preferably, the solid base 96 is larger in diameter than cylindrical body 94 to prevent the hole cutter 61 from passing entirely out of the casing 20. The cylindrical body 94 of hole cutter 61 is preferably ¾–1¼ inches in diameter, more preferably 1 inch in diameter, and is preferably ⅜–1 inch long, more preferably ¾ inch long. Preferably, the serrated end has a pitch of 4–6 teeth per inch, more preferably 6 teeth per inch. A magnet 98 can be located inside the cylindrical body 94 and attached to the base 96 to retain one or more coupons removed from the casing 20, which is conventionally made from steel, when a hole has been completed. Alternatively, the coupon or disc may be left in the formation and subsequently pushed out of the path of the boring nozzle by the high pressure water.

Figure 8:
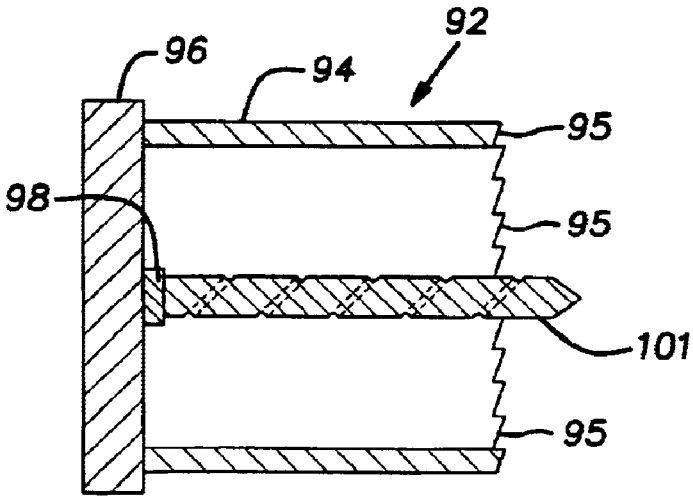
FIG. 8 is a side view as in FIG. 7, including an arbor.

Referring to FIG. 8, in a preferred embodiment the hole cutter 61 includes a stabilizer bit or arbor 101. Preferably, the arbor 101 extends at least partly forward of the terminal end of the body 94 as shown in the figure.

It has been found that surprisingly good results have been achieved in this application by using a standard hole saw as compared to conventional milling cutters. It is believed that this excellent performance comes from the ability of the hole saw to cut a relatively large hole while only removing a proportionally small amount of material.

The multi-conductor cable 17 extends down through a slot 31 milled into the walls of the rotating section 11. The multi-conductor cable 11 leads to and is connected through grommets 32 to a bi-directional, variable speed DC motor 30 in the motor housing 24. The DC motor 30, which is controlled by an operator on the surface through the multi-conductor cable 17, and vertically stabilized by security plugs 33 to keep the motor from spinning within the motor housing 24. This DC motor rotates the vertical transfer bar or drive shaft 22 extending upward, through a radial roller bearing 34 at each end of the shaft to aid in support and rotation, to the ring gear 21, to turn the rotating section 11.

The multi-conductor cable 17 continues down through the milled slot 31 in the cylindrical battery/gyroscope compartment 25 to both the battery pack 35 and a gyroscope 36 which are secured within the compartment 25. The DC battery pack 35 preferably comprises lithium batteries or other power supplies known in the art. The lithium batteries 35 provide power to the DC motor 30 and to the gyroscope 36.

The gyroscope 36 may be an inertial or rate type gyroscope or any other type of gyroscope known in the art. The gyroscope 36, fixed relative to the rotating section 11 and specifically aligned to the exit hole of the cutter support body 23, communicates the precise direction in degrees of the position of the rotating section to the operator on the surface via the multiconductor cable 17. Alternatively, this data can be relayed by wireless transmissions to allow the operator to operate the motor 30 in order to turn the rotating section 11 to the desired position to cut a hole in the well casing 20, or to a previously cut hole allowing the high pressure water hose and jet blasting nozzle to begin the boring process (not shown). In the absence of the preferable gyroscope 36, other methods, known in the art, for indicating the angular position of the rotating section 11 can be used. This will provide a starting point and will be used to position the rotating section 11 for initial and sequential hole cutting and boring.

A beveled cylindrical metal shoe guide 37 caps the bottom of the rotating section 11 for ease in lowering the entire shoe assembly 5 through the well casing 20 to the desired depth.

A tail pipe 38, shown in phantom, may carry a gamma ray sensor or other type of logging tool known in the art, and can be used to determine the location of a hydrocarbon payzone or multiple payzones. This logging tool may be screwed into or otherwise attached to the shoe guide 37. A packer 39, shown in phantom, may be attached to the tailpipe 38. The packer 39 as known in the art, preferably made of inflatable rubber, is configured in such a way that when it is expanded there are one or more channels, notches or passageways to allow the free flow of fluid, gas and fines up and down the casing 20. When expanded, the packer 39 stabilizes the position of the shoe assembly 5 restricting its ability to move up or down the well bore thus reducing a potential problem of being unable to reenter holes in the side of the casing.

In operation, when the well casing 20 is clear of all pumping, data collecting or other working or instrumentation fixtures, the entire shoe assembly 5 is threaded into the down-hole end of the upset tubing 52 or any other means by which to transport the entire assembly 5 to the desired depth within the well casing 20.

The technicians on the surface employ the high strength wire cable 8 to lower the drilling apparatus 12 down the inside of the upset tubing 52 into the fixed section of the shoe assembly 10. The design of the drill motor housing will ensure that the drill apparatus 12 will properly align itself and seat into the anti-spin lugs 16 in the fixed section central channel 53. Sensors can be installed into the shoe assembly so that lights or other methods of indication on or at the control console, usually inside a truck, could provide a variety of information to the operator.

Once the shoe assembly 5 is at the desired depth, the operator then rotates the lower portion of the shoe by activating a rheostat or other controlling device located at the surface, and monitors a readout as to the shoe's direction via the signals provided by the multi-conductor 17. This engages the battery 35, bi-directional motor 30, and gyroscope 36 assembly by which the operator can manipulate the direction of the shoe to the desired direction or heading based on customer needs.

Technicians on the surface lower the drilling apparatus 5 so that the mechanical power on switch 15 turns on the drill motor 57 at the proper rate, turning the flexible drill shaft 59 and cutter 61. As the serrated edge of the cutter 61 contacts the wall of the well casing 20, it begins to form a groove in the casing 20. The selected mass of weight of the sinker bars 9 provide the appropriate thrust to the cutter. The groove deepens until a disc or coupon is cut out of the casing wall. The proximity sensor 50 senses the presence of the chuck 58 in the annular clearance in the inner guide housing 64, and indicates to the operator that the hole has been completed.

Once the operator has cut the initial hole, he pulls the drilling apparatus up the hole approximately 20 feet to ensure that the flexible cable is not obstructing the shoe's ability to be turned to the next direction again uses the data provided from gyroscope 36 in the battery/gyroscope compartment 25 end sends a signal to the bi-directional, variable speed DC motor 30 turn the rotating section 11 a specified number of degrees to cut the next hole. This process continues at that same desired depth until all the desired holes are cut in the well casing 20. Preferably, several sequential holes are cut at the same depth before brining the drill apparatus 12 to the surface.

The technicians on the surface connect a high pressure jet nozzle known in the art (not shown), to the discharge end of a high pressure hose (not shown), which is connected to a flexible coil tubing, and begin to lower the nozzle down the upset tubing 52 and into the shoe assembly 5. Once the nozzle is seated in the elbow-shaped channel 29 in the cutter support body 23, the suction connection of the hose is connected to the discharge connection of a very high pressure pump (not shown). The very high pressure pump will be of a quality and performance acceptable in the art. The pump is then connected to an acceptable water source; usually a mobile water truck (not shown).

The technicians then advise the operator at the control console that they are ready to begin the boring process. The operator, using the information provided from the gyroscope 36, ensures that the cutter support body 23 is aligned with the desired hole in the well casing and advises the technicians to begin the boring process.

The technicians turn on the pump, open the pump suction valve and the high pressure water in the hose forces the nozzle through the elbow-shaped channel 29 and the hole in the casing and into the hydrocarbon payzone (not shown). The design of the jet nozzle housing, as known it the art, provides for both a penetrating stream of high pressure water to penetrate into the zone, and small propelling water jet nozzles located peripherally on the back of the nozzle to propel the nozzle into the zone. The technicians on the surface monitor the length of hose moving into the upset tubing 52 and turn the water off and retract the nozzle back into the elbow-shaped channel 29 when the desired length of penetration has been achieved.

With information provided by the gyroscope 36, the operator, at the control console, now rotates the shoe assembly to the next hole in line and the boring process can be repeated again. Once the boring process has been completed at a specific depth and the boring nozzle retrieved to the surface, the upset tubing 52 and shoe assembly 5 may be completely removed from the well casing, or alternatively raised or lowered to another depth to begin the process once again.

It is contemplated that the invention can be practiced with an assembly like that described above, but without a bi-directional variable speed DC motor 30, drive shaft 22, ring gear 21 and related components that enable the rotating section 11 to rotate in respect to the fixed section 10. In that case the shoe assembly 5 would comprise only fixed sub-assemblies. In such a case the entire assembly would be rotated by physically turning the upset tubing 52 from the surface. The data provided from the gyroscope 36 would be used to similarly locate the hole cutting locations and boring positions as described. While an electric motor is preferred for operating the cutter 61, a mud motor, known in the art, can alternatively be used. The mud motor is driven by fluid pumped through coil tubing connected to it from the surface.

Apart from the specific disclosures made here, data and information from the proximity sensor 50, gyroscope 36, gamma ray sensor, sonar or other sensors that may be used, may be transmitted to the operator on the surface by optical fiber, electrical conduit, sound or pressure waves as known in the art. Similarly, both the drill motor 57 and the bi-directional, variable speed DC motor 30 can be driven directly from the surface through appropriate power cables.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What it claimed is:

1. Apparatus for drilling in a well, said apparatus comprising a shoe assembly and a hole saw, said shoe assembly being adapted to be lowered into a casing of the well and to direct said hole saw in a predetermined direction at a depth at which a hole or holes are to be cut in a casing wall of said well, said shoe assembly having a longitudinal pathway adapted to receive said hole saw therein, and a lateral pathway oriented at an angle relative to, and in fluid communication with, said longitudinal pathway, said lateral pathway being adapted to receive said hole saw from said longitudinal pathway and to direct said hole saw against said casing wall, said hole saw comprising a hollow cylindrical body having, at a serrated end thereof, a serrated edge comprising a plurality of cutting teeth.

2. Apparatus according to claim 1, said hole saw further comprising a solid base at a proximal end thereof opposite said serrated end.

3. Apparatus according to claim 1, said casing having an inner surface and an outer surface, said cutting teeth at said serrated edge being effective to cut a circular groove in said inner surface of said casing during a drilling operation.

4. Apparatus according to claim 3, said cutting teeth being further effective to cut a coupon out of said well casing during a drilling operation.

5. Apparatus according to claim 1, said hole saw being effective to cut and retain a coupon from said well casing, and a core of surrounding formation beyond said well casing.

6. Apparatus according to claim 5, wherein the condition of said well casing is determined from said coupon.

7. Apparatus according to claim 5, wherein the composition of said surrounding formation is determined from said core thereof.

8. Apparatus according to claim 1, said shoe assembly further comprising a support body for supporting said hole saw adjacent an angular location at which it is desired to form a hole in said well casing.

9. Apparatus according to claim 8, said shoe assembly further comprising a hardened bushing to support said hole saw during rotation thereof, said bushing guiding said hole saw in a predetermined direction.

10. Apparatus according to claim 1, further comprising an electric motor to operate said hole saw.

11. Apparatus according to claim 1, further comprising a mud motor to operate said hole saw.

12. Apparatus according to claim 1, further comprising a gyroscope adapted to transmit a signal to indicate an angular location of the hole saw within said well casing.

13. Apparatus according to claim 12, said shoe assembly further comprising a support body for supporting said hole saw adjacent an angular location at which it is desired to form a hole in said well casing, said gyroscope being fixed resistive to said support body, and being adapted to transmit a signal to indicate the angular location of the support body.

14. Apparatus according to claim 1, said hole saw having a diameter of ¾–1¼ inches.

15. Apparatus according to claim 1, said hole saw having a length of ⅜–1 inch.

16. Apparatus according to claim 2, said solid base having a larger diameter than said hollow cylindrical body of said hole saw.

17. Apparatus according to claim 1, said serrated edge having a pitch of 4–6 teeth per inch.

18. Apparatus according to claim 1, said hole saw further comprising an arbor.

19. Apparatus according to claim 18, said arbor extending at least partly forward of said serrated edge of said cylindrical body.

20. Apparatus according to claim 18, said arbor being adapted to retain a coupon that has been cut from said well casing by said hole saw.

21. Apparatus for horizontally drilling in a well comprising a shoe assembly and a hole saw, said shoe assembly being adapted to be lowered into a casing of the well and to direct said hole saw in a predetermined direction at a depth at which a hole or holes are to be drilled in a casing wall of said well, said hole saw comprising a hollow cylindrical body having a proximal edge, a distal, serrated edge comprising a plurality of cutting teeth, and a solid base adjacent said proximal edge, said hole saw further comprising a magnet within said hollow cylindrical body and attached to said solid base.

22. A method of drilling in a well comprising providing a hole saw, lowering the hole saw down into a well casing to a desired depth and redirecting said hole saw along a predetermined path, engaging said hole saw against an inner concave surface of said well casing, and cutting a coupon out of said well casing by operating said hole saw against said well casing.

23. A method according to claim 22, said hole saw comprising a hollow cylindrical body having, at a serrated end thereof, a serrated edge comprising a plurality of cutting teeth.

24. A method according to claim 22, said hole saw further comprising an arbor.

25. A method according to claim 22, further comprising:

lowering a shoe assembly into said well casing to said desired depth, said shoe assembly being adapted to receive said hole saw from the surface and to redirect said hole saw along said predetermined path; and lowering said hole saw into said well casing after said shoe assembly has been lowered therein so that said hole saw is received and redirected along said predetermined path by said shoe assembly.

26. A method according to claim 25, said shoe assembly comprising a longitudinal pathway adapted to receive said hole saw therein, and a lateral pathway oriented at an angle relative to, and in fluid communication with, said longitudinal pathway, said lateral pathway being adapted to receive said hole saw from said longitudinal pathway and to direct said hole saw against said casing wall along said predetermined path.

27. Apparatus for drilling in a well, said apparatus comprising a shoe assembly and a hole saw, said shoe assembly being adapted to be lowered into a casing of the well and to direct said hole saw in a predetermined direction at a depth at which a hole or holes are to be cut in a steel casing wall of said well casing, said hole saw comprising a hollow cylindrical body having, at a serrated end thereof, a serrated edge comprising a plurality of cutting teeth, and an arbor extending at least partly forward of said serrated edge of said cylindrical body, said hole saw being effective to cut through said steel casing wall.

28. Apparatus according to claim 27, said cutting teeth being effective to cut a coupon out of said steel casing wall during operation of said hole saw.

29. Apparatus according to claim 27, said hole saw being effective to cut and retain a coupon from said steel casing wall, and a core of surrounding formation beyond said casing wall.

30. Apparatus according to claim 27, further comprising en electric motor to operate said hole saw.

31. Apparatus according to claim 27, further comprising a gyroscope adapted to transmit a signal to indicate an angular location of the hole saw within said well casing.

32. Apparatus according to claim 27, said shoe assembly having a longitudinal pathway adapted to receive said hole saw therein, and a lateral pathway oriented at an angle relative to, and in fluid communication with, said longitudinal pathway, said lateral pathway being adapted to receive said hole saw from said longitudinal pathway and to direct said hole saw against said steel casing wall.

33. A method according to claim 22, further comprising cutting a core from a formation surrounding said well casing by operation of said hole saw.

* * * * *